US010616687B2

(12) United States Patent
Kim et al.

(10) Patent No.: US 10,616,687 B2
(45) Date of Patent: Apr. 7, 2020

(54) MICROPHONE AND MANUFACTURING METHOD THEREOF

(71) Applicants: HYUNDAI MOTOR COMPANY, Seoul (KR); KIA MOTORS CORPORATION, Seoul (KR)

(72) Inventors: Hyunsoo Kim, Seoul (KR); Ilseon Yoo, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/001,448

(22) Filed: Jun. 6, 2018

(65) Prior Publication Data

US 2018/0288528 A1 Oct. 4, 2018

Related U.S. Application Data

(62) Division of application No. 15/385,193, filed on Dec. 20, 2016, now abandoned.

(30) Foreign Application Priority Data

Sep. 2, 2016 (KR) ..... 10-2016-0113198

(51) Int. Cl.

| | |
|---|---|
| ***H04R 7/26*** | (2006.01) |
| ***H04R 19/00*** | (2006.01) |
| ***H04R 19/04*** | (2006.01) |
| ***H04R 31/00*** | (2006.01) |

(52) U.S. Cl.

CPC ..... *H04R 7/26* (2013.01); *H04R 19/005* (2013.01); *H04R 19/04* (2013.01); *H04R 31/003* (2013.01); *H04R 2201/003* (2013.01); *H04R 2410/03* (2013.01)

(58) Field of Classification Search

CPC ..... H04R 7/26; H04R 31/003

See application file for complete search history.

(56) References Cited

U.S. PATENT DOCUMENTS

| | | | | |
|---|---|---|---|---|
| 5,146,435 | A | 9/1992 | Bernstein | |
| 8,146,437 | B2 | 4/2012 | Miyoshi et al. | |
| 8,422,702 | B2 * | 4/2013 | Kim | H04R 19/005 381/174 |
| 8,948,419 | B2 | 2/2015 | Zhang | |
| 9,066,180 | B2 * | 6/2015 | Zoellin | H04R 19/005 |

(Continued)

FOREIGN PATENT DOCUMENTS

| | | | |
|---|---|---|---|
| JP | 5267627 | B2 | 8/2013 |
| KR | 10-0740462 | B1 | 7/2007 |

(Continued)

*Primary Examiner* — Matthew L Reames

(74) *Attorney, Agent, or Firm* — Morgan, Lewis & Bockius LLP

(57) ABSTRACT

A microphone includes a substrate including an acoustic hole; a supporting layer disposed along a circumference of the substrate; and a vibrating film disposed on the supporting layer and spaced apart from the substrate, wherein the vibrating film includes a first vibrating region positioned at a portion corresponding to the acoustic hole; a second vibrating region connected to the first vibrating region, and including an air inlet; and a third vibrating region connected to the second vibrating region through a plurality of connection parts.

6 Claims, 14 Drawing Sheets

(56) References Cited

U.S. PATENT DOCUMENTS

| | | | | |
|---|---|---|---|---|
| 9,078,068 | B2 | 7/2015 | Langlois et al. | |
| 9,078,069 | B2 | 7/2015 | Bharatan et al. | |
| 9,400,224 | B2 | 7/2016 | Chen et al. | |
| 9,676,615 | B2 | 6/2017 | Miao | |
| 2007/0045757 | A1* | 3/2007 | Matsubara ..... | H04R 19/005 257/416 |
| 2007/0147650 | A1 | 6/2007 | Lee et al. | |
| 2010/0278372 | A1 | 11/2010 | Zhang | |
| 2015/0245146 | A1 | 8/2015 | Liu et al. | |
| 2016/0112807 | A1* | 4/2016 | Yuan ..... | H04R 19/04 381/174 |
| 2017/0347185 | A1 | 11/2017 | Kim et al. | |

FOREIGN PATENT DOCUMENTS

| | | | |
|---|---|---|---|
| KR | 10-0977826 | B1 | 8/2010 |
| KR | 10-2011-0125589 | A | 11/2011 |
| KR | 10-1407914 | B1 | 6/2014 |
| KR | 2016-0063145 | A | 6/2016 |

* cited by examiner

MICROPHONE AND MANUFACTURING METHOD THEREOF

CROSS-REFERENCE TO RELATED APPLICATION

This application is a Divisional of U.S. patent application Ser. No. 15/385,193, filed Dec. 20, 2016, which claims the benefit of priority to Korean Patent Application No. 10-2016-0113198 filed on Sep. 2, 2016, the contents of which are incorporated herein by reference.

TECHNICAL FIELD

The present disclosure relates to a microphone, and more particularly, to a microphone capable of minimizing a damping by omitting a fixed film, and a manufacturing method thereof.

BACKGROUND

A microphone is generally a device converting voice into an electrical signal. The microphone should have good electronic and acoustic performance, reliability, and operability. Recently, a demand for a smaller microphone has been increased. Accordingly, a microphone using a micro electro mechanical system (MEMS) technology has been developed.

The MEMS microphone is manufactured using a semiconductor batch process. The MEMS microphone has a tolerance to heat and humidity as compared to a conventional electric condenser microphone (ECM), and may be down-sized and be integrated with a signal processing circuit.

In addition, the MEMS microphone has excellent sensitivity and low performance deviation for each of the products as compared to the conventional ECM. Accordingly, the MEMS microphone has been applied to many application fields instead of the ECM.

The MEMS microphone is generally classified into a piezoelectric MEMS microphone and a capacitive MEMS microphone.

The piezoelectric MEMS microphone includes a vibrating film, and when the vibrating film is deformed by external sound pressure, the electrical signal is generated by a piezoelectric effect to allow the sound pressure to be measured.

The capacitive microphone includes a fixed film and a vibrating film, and when the sound pressure is externally applied to the vibrating film, a capacitance value is changed while an interval between the fixed film and the vibrating film is changed. The sound pressure is measured by an electrical signal generated at this time.

However, since the conventional microphone requires two films such as the vibrating film and the fixed film to configure a parallel capacitor form, a process step thereof is complex. In addition, since a dimple structure should be formed in the vibrating film or the fixed film to prevent a stiction, an additional process is required, which causes a problem that manufacturing costs are increased.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a microphone having advantage of removing a fixed film and including only a vibrating film, and a manufacturing method thereof.

Further, the present disclosure has been made in an effort to provide a microphone having advantage of including a slot or a through-hole in one side of a vibrating film, and a manufacturing method thereof.

According to an exemplary embodiment of the present disclosure, a microphone includes: a substrate including an acoustic hole; a supporting layer disposed along a circumference of the substrate; and a vibrating film disposed on the supporting layer and spaced apart from the substrate, wherein the vibrating film includes a first vibrating region positioned at a portion corresponding to the acoustic hole; a second vibrating region connected to the first vibrating region, and including an air inlet; and a third vibrating region connected to the second vibrating region through a plurality of connection parts.

The air inlet may include a first slot positioned between two connection parts; and a plurality of through-holes positioned between the first vibrating region and the first slot.

The air inlet may further include a bending part bent toward the first vibrating region at both end portions of the first slot.

The air inlet may include a second slot positioned between two connection parts.

A width of the first slot may be different from a width of the second slot.

A width of the second slot may be greater than a width of the first slot.

The vibrating film may include a plurality of protrusions protruding on one surface thereof.

An inner circumference surface of the acoustic hole may be formed in an inclined surface.

The acoustic hole may be formed in an inclined surface of which an inner diameter decreases toward the vibrating film.

The microphone may further include a first pad connected to the vibrating film; and a second pad connected to the substrate.

The microphone may further include an insulating layer disposed on the substrate; and an electrode layer disposed on the insulating layer and being in contact with the second pad.

According to another embodiment of the present disclosure, a manufacturing method of a microphone includes: preparing a substrate; forming a sacrificial layer on the substrate; forming a conductive layer on the sacrificial layer; forming an insulating film on the conductive layer and forming the conductive layer as a vibrating film; etching the substrate to form an acoustic hole; and etching the sacrificial layer to form a supporting layer along a circumference of the substrate, wherein the vibrating film includes a first vibrating region positioned at a portion corresponding to the acoustic hole; a second vibrating region connected to the first vibrating region, and including an air inlet; and a third vibrating region connected to the second vibrating region through a plurality of connection parts.

According to the embodiments of the present disclosure, since the process step may be reduced by removing the fixed film, the manufacturing costs may be cheaper, and since the damping which may occur in an air layer disposed between the vibrating film and the fixed film may be minimized, frequency response characteristics and noise characteristics may be improved, and an occurrence of a stiction phenomenon may be prevented.

Further, the slot or the through-hole is disposed in one side of the vibrating film, thereby making it possible to maximize displacement of the vibrating film.

Other effects that may be obtained or predicted from the exemplary embodiments of the present disclosure will be explicitly or implicitly disclosed in the detailed description of the exemplary embodiments of the present disclosure. That is, various effects predicted according to the exemplary embodiments of the present disclosure will be disclosed in the detailed description to be described below.

DETAILED DESCRIPTION OF THE EMBODIMENTS

Hereinafter, an operation principle of exemplary embodiments of a microphone and a manufacturing method thereof according to the present disclosure will be described in detail with reference to the accompanying drawings and the description. However, the drawings illustrated below and the detailed description to be described below relate to one exemplary embodiment among several exemplary embodiments for effectively describing characteristics of the present disclosure. Therefore, the present disclosure should not be limited to only the following drawings and description.

In addition, in describing the present disclosure, a detailed description for well-known functions or configurations will be omitted in the case in which it is determined that the detailed description may unnecessarily obscure the gist of the present disclosure. In addition, the following terminologies are defined in consideration of the functions in the present disclosure and may be construed in different ways by the intention of users and operators, a custom, or the like. Therefore, the definitions thereof should be construed based on the contents throughout the present disclosure.

In addition, in the following exemplary embodiments, in order to efficiently describe critical technical characteristics of the present disclosure, the terminologies are appropriately deformed, integrated, or separated to be used so that those skilled in the art may clearly understand, but the present disclosure is not necessarily limited thereto.

Hereinafter, exemplary embodiments of the present disclosure will be described in detail with reference to the accompanying drawings.

Figure 1:
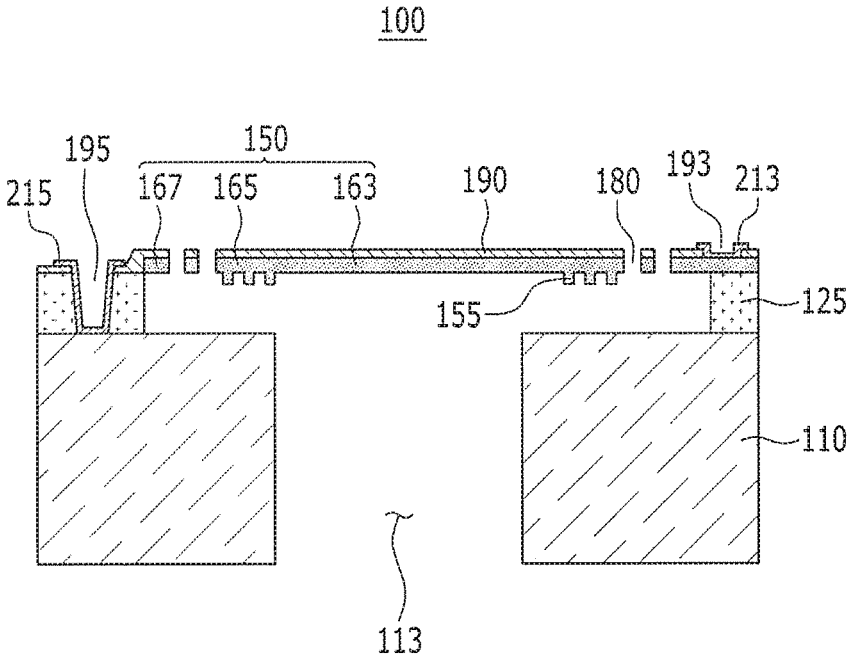
FIG. 1 is a drawing illustrating a microphone according to an exemplary embodiment of the present disclosure.
Figure 2:
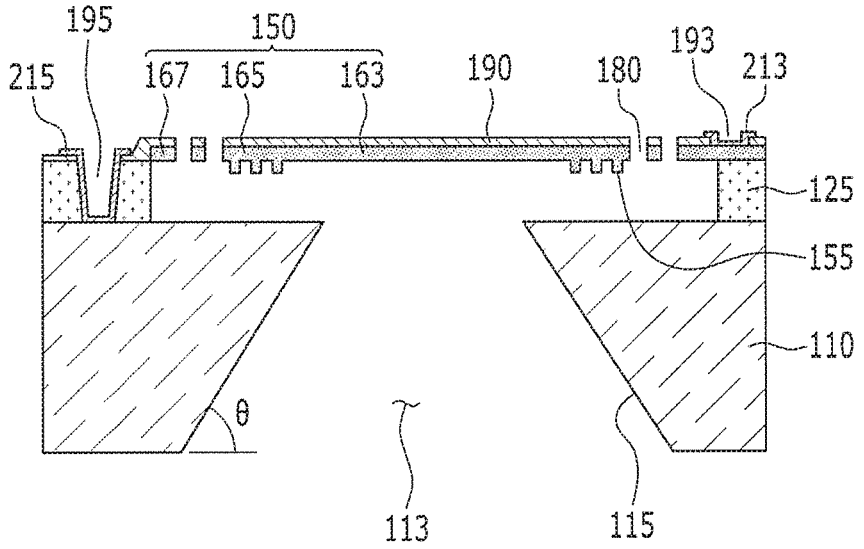
FIG. 2 is a drawing illustrating a microphone according to another exemplary embodiment of the present disclosure.
Figure 3:
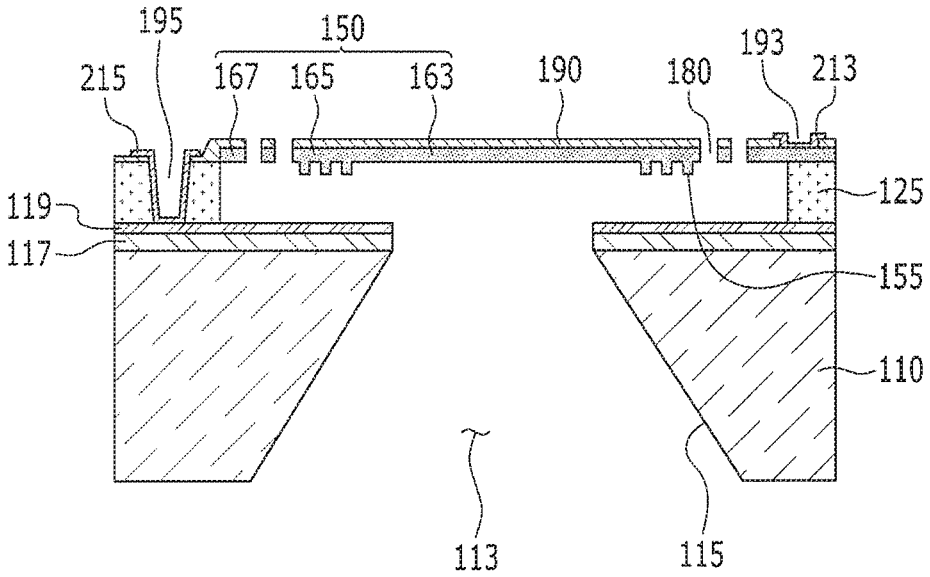
FIG. 3 is a drawing illustrating a microphone according to still another exemplary embodiment of the present disclosure.

FIG. 1 is a drawing illustrating a microphone according to an exemplary embodiment of the present disclosure, FIG. 2 is a drawing illustrating a microphone according to another exemplary embodiment of the present disclosure, and FIG. 3 is a drawing illustrating a microphone according to still another exemplary embodiment of the present disclosure.

Referring to FIG. 1, a microphone 100 according to the present disclosure processes an acoustic signal introduced from the outside and transmits the processed acoustic signal to a processing module (not shown). That is, the microphone 100 receives the acoustic signal through an acoustic hole 113 formed in a substrate 110, and is vibrated by sound pressure according to the acoustic signal to transmit a changed capacitance signal to the processing module.

To this end, the microphone 100 includes the substrate 110, a supporting layer 125, a vibrating film 150, and an insulating film 190.

The substrate 110 includes the acoustic hole 113 formed in the central portion thereof. The acoustic signal is introduced into the microphone 100 through the acoustic hole 113 formed in the substrate 110.

The substrate 110 may serve as the fixed film according to the related art. Accordingly, the microphone 100 according to the present disclosure vibrates the vibrating film 150 by the sound pressure to change capacitance between the substrate 110 and the vibrating film 150, and transmits the changed capacitance signal to the processing module through a second pad 215 connected to the substrate 110.

The substrate 110 may be a heavily doped wafer. In addition, the substrate 110 may also be formed of silicon.

An inner circumference surface of the acoustic hole 113 may be perpendicular to an outer surface of the substrate 110. A cross section of the acoustic hole 113 may be formed in a rectangular or square shape, as illustrated in FIG. 1.

Meanwhile, the acoustic hole 113 may have the inner circumference surface formed in an inclined surface 115 as illustrated in FIG. 2. The acoustic hole 113 may have the inclined surface 115 of which an inner diameter decreases toward the vibrating film 150.

An inclination angle (θ) of the inclined surface 115 may be formed at a set angle with respect to the outer surface of the substrate 110. For example, the set angle may be 50° to 60°.

The cross section of the acoustic hole 113 may be formed in a trapezoidal shape, as illustrated in FIG. 2.

Accordingly, since the inner circumference surface of the acoustic hole 113 is formed in the inclined surface 115, the microphone 100 according to the present disclosure may collect the acoustic signal and transmit the collected acoustic signal to the vibrating film 150.

The supporting layer 125 is formed on the substrate 110. That is, the supporting layer 125 is formed along a circumference of the substrate, and supports the vibrating film 150.

A second contact hole 195 for exposing the substrate 110 is formed in the supporting layer 125. A second pad 215 is formed in the second contact hole 195.

The second pad 215 is formed in the second contact hole 195, and is connected to the substrate 110. The second pad 215 may be made of a metal.

The vibrating film 150 is formed on the supporting layer 125. The vibrating film 150 is spaced apart from the substrate 110.

An air layer is formed between the substrate 110 and the vibrating film 150. The substrate 110 and the vibrating film 150 are spaced apart from each other by a predetermined interval. The acoustic signal is introduced from the outside through the acoustic hole 113 to stimulate the vibrating film 150, by which the vibrating film 150 is vibrated. In this case, an interval between the substrate 110 and the vibrating film 150 is changed. Accordingly, capacitance between the substrate 110 and the vibrating film 150 is changed. The capacitance signal changed as described above is output to the processing module through the first pad 213 connected to the vibrating film 150 and the second pad 215 connected to the substrate 110.

The vibrating film 150 includes a plurality of protrusions 155 formed on one surface thereof. That is, the protrusions 155 may be formed on a lower surface of the vibrating 150. The protrusions 155 may prevent the vibrating film 150 from being in contact with the substrate 110 when the vibrating film 150 is vibrated.

The vibrating film 150 includes a first vibrating region 163, a second vibrating region 165, and a third vibrating region 167. The first vibrating region 163 is formed to correspond to the acoustic hole 113, and the second vibrating region 165 includes an air inlet 180.

The vibrating film 150 may be formed of polysilicon or a conductive material.

The above-mentioned vibrating film 150 will be described in detail with reference to FIGS. 4 and 5.

The insulating film 190 is formed on the vibrating film 150. The insulating film 190 may be formed of silicon nitride.

A first contact hole 193 for exposing the vibrating film 150 is formed in the insulating film 190. The first pad 213 is formed in the first contact hole 193.

The first pad 213 is formed in the first contact hole 193, and is connected to the vibrating film 150. The first pad 213 may be made of a metal.

The microphone 100 according to the present disclosure may further include an insulating layer 117 and an electrode layer 119, as illustrated in FIG. 3.

The insulating layer 117 is formed on the substrate 110. That is, the insulating layer 117 may be formed on the substrate 110 controlling a portion in which the acoustic hole 113 is formed. The insulating layer 117 may be formed of silicon nitride.

The electrode layer 119 is formed on the insulating layer 117, and is formed between the second pad 215 and the substrate 110. That is, the electrode layer 119 is connected to the second pad 215.

The electrode layer 119 may be formed of polysilicon or a conductive material.

Accordingly, the vibrating film 150 is vibrated by the sound pressure, and the interval between the electrode layer 119 and the vibrating film 150 formed on the substrate 110 is changed. Accordingly, capacitance between the electrode layer 119 and the vibrating film 150 is changed. The capacitance signal changed as described above is output to the processing module through the first pad 213 connected to the vibrating film 150 and the second pad 215 connected to the electrode layer 119.

Figure 4:
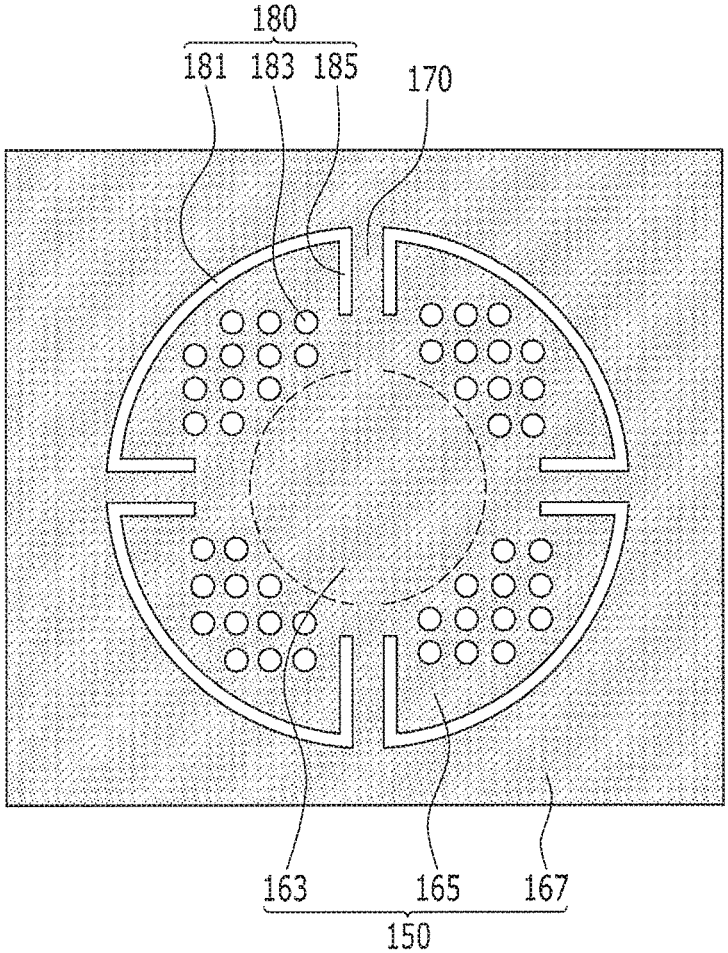
FIG. 4 is a plan view illustrating a vibrating film according to an exemplary embodiment of the present disclosure.
Figure 5:
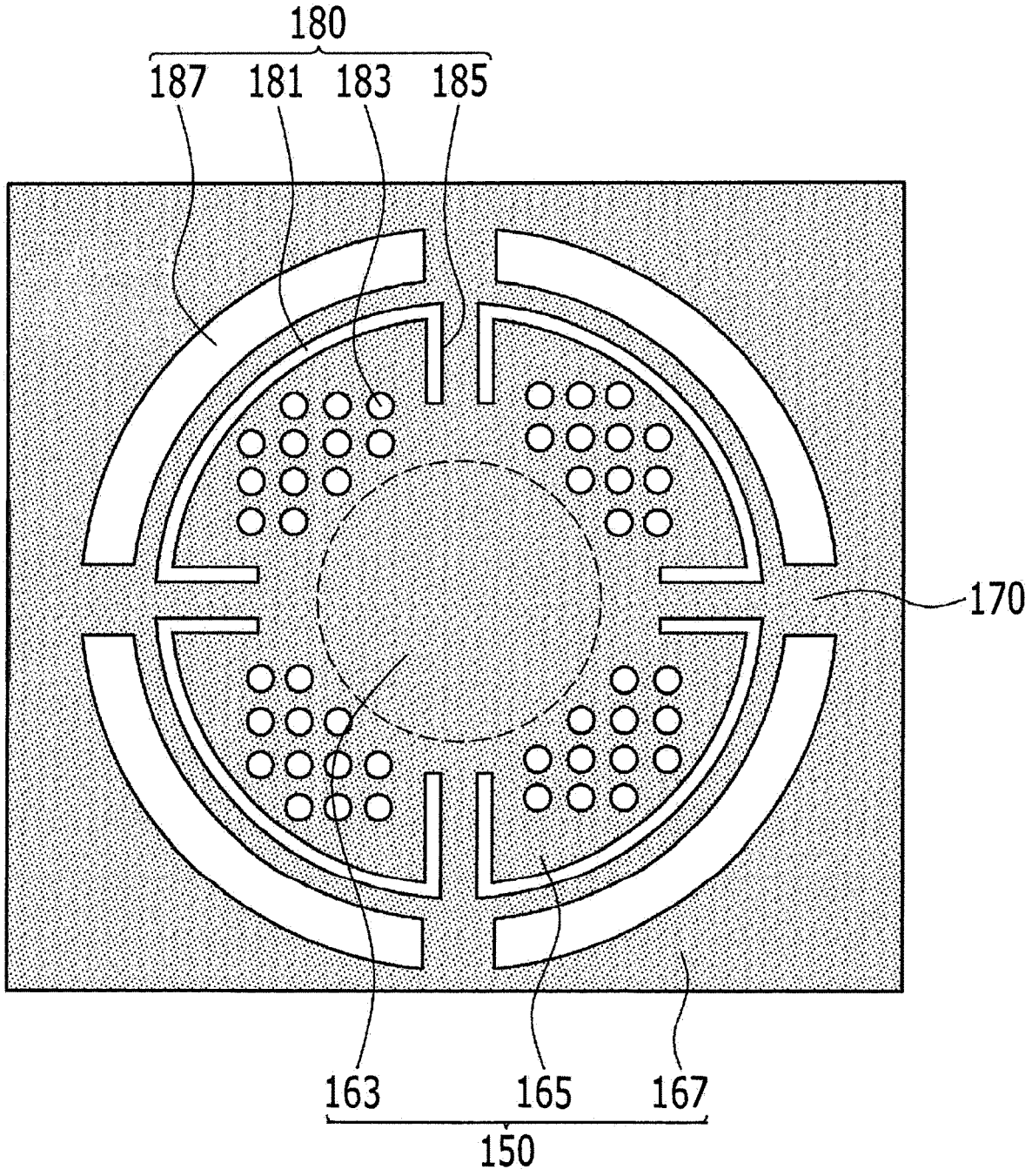
FIG. 5 is a plan view illustrating a vibrating film according to another exemplary embodiment of the present disclosure.

FIG. 4 is a plan view illustrating a vibrating film according to an exemplary embodiment of the present disclosure, and FIG. 5 is a plan view illustrating a vibrating film according to another exemplary embodiment of the present disclosure.

Referring to FIG. 4, the vibrating film 150 includes the first vibrating region 163, the second vibrating region 165, and the third vibrating region 167.

The first vibrating region 163 is formed at a center of the vibrating film 150, and is positioned at a portion corresponding to the acoustic hole 113 formed in the substrate 110.

The second vibrating region 165 is connected to the first vibrating region 163, and includes the air inlet 180. Since the air inlet 180 is formed in the second vibrating region 165 as described above, the microphone 100 according to the present disclosure concentrates the acoustic signal to the first vibrating region 163, thereby making it possible to maximize displacement of the vibration.

The third vibrating region 167 is connected to the second vibrating region 165 through a plurality of connection parts 170. Since the connection parts 170 serve as a bridge, the first vibrating region 163 and the second vibrating region 165 are vibrated by the sound pressure of the acoustic signal introduced from the outside.

The air inlet 180 includes a first slot 181, a through-hole 183, and bending part 185.

The first slot 181 is formed between the connection part 170 and the connection part 170. That is, the first slot 181 is formed between the second vibrating region 165 and the third vibrating region 167.

The through-hole 183 is positioned between the first vibrating region 163 and the first slot 181. A plurality of through-holes 183 may be formed.

The bending part 185 is formed to be bent toward the first vibrating region 163 at both end portions of the first slot 181.

The air inlet 180 further includes a second slot 187 as illustrated in FIG. 5.

The second slot 187 is formed between the connection parts 170.

A width of the second slot 187 may be formed to be different from a width of the first slot 181. That is, the width of the second slot 187 may be formed to be greater than the width of the first slot 181.

Accordingly, since the entirety of the vibrating film 150 has a piston type motion, the microphone 100 according to the present disclosure may obtain a large capacitance change in a limited area, thereby making it possible to improve sensitivity.

In addition, the microphone 100 according to the present disclosure adjusts an area of the air inlet 180, thereby making it possible to adjust sensitivity and noise performance.

A manufacturing method of a microphone according to an exemplary embodiment of the present disclosure will be described with reference to FIGS. 6 to 14.

FIGS. 6 to 14 are diagrams sequentially illustrating a manufacturing method of a microphone according to an exemplary embodiment of the present disclosure.

Figure 6:
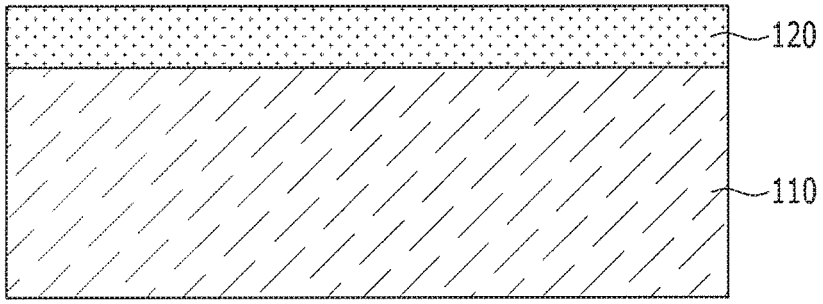
FIGS. 6 to 14 are diagrams sequentially illustrating a manufacturing method of a microphone according to an exemplary embodiment of the present disclosure.

Referring to FIG. 6, a sacrificial layer 120 is formed on the substrate 110.

In other words, in order to form the microphone 100, the substrate 110 is prepared, and the sacrificial layer 120 is formed on one side of the substrate 110. In this case, the substrate 110 may be formed of silicon, and the sacrificial 120 may be formed of silicon oxide or silicon nitride.

Figure 7:
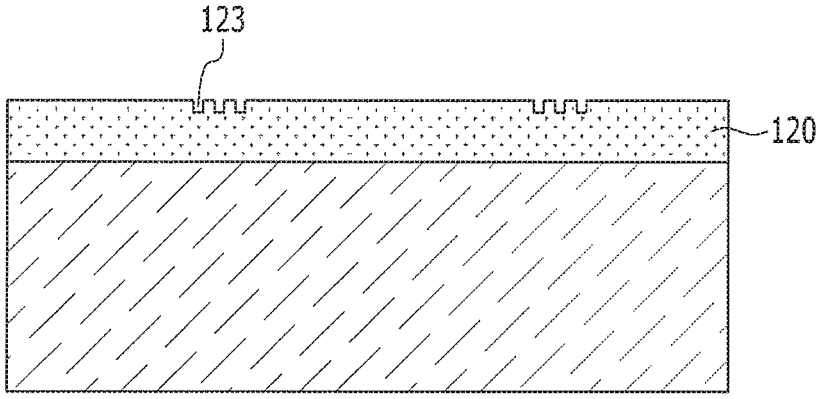

Referring to FIG. 7, a plurality of depressed parts 123 are formed in the sacrificial layer 120. That is, an upper portion of the sacrificial layer 120 is etched to form the plurality of depressed parts 123.

Figure 8:
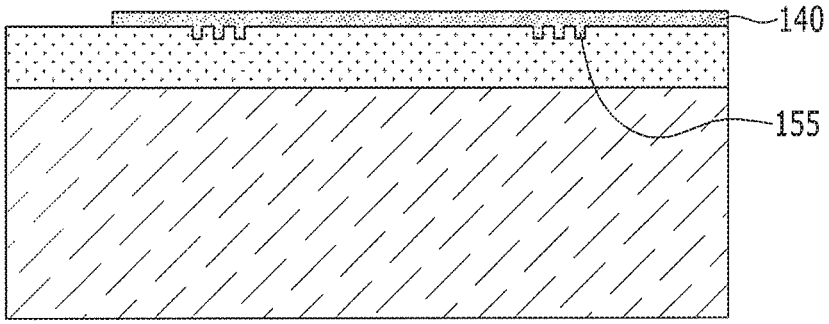

Referring to FIG. 8, a conductive layer 140 for forming the vibrating film 150 is formed on the sacrificial layer 120. In this case, a plurality of protrusions 155 are formed on the conductive layer 140 so as to be inserted into the plurality of depressed parts 123 formed in the sacrificial layer 120. The conductive layer 140 may be formed of polysilicon or a conductive material.

Figure 9:
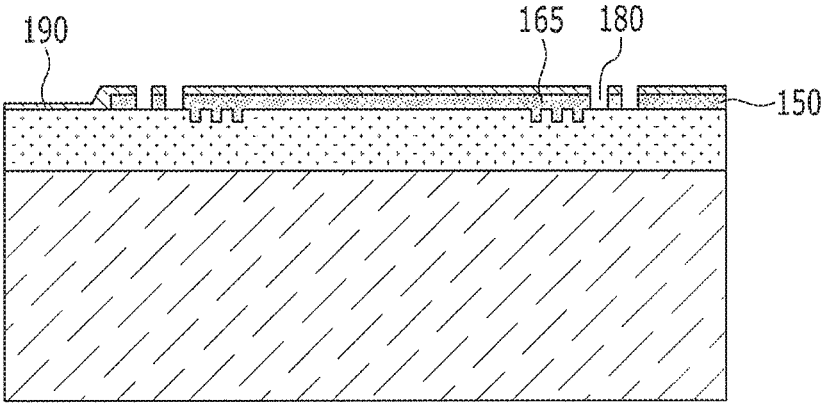

Referring to FIG. 9, the insulating film 190 is formed on the conductive film 140, and the conductive layer 140 is etched to form the vibrating film 150.

In other words, the insulating film 190 formed of silicon nitride is formed on the conductive layer 140. In addition, the conductive layer 140 is etched to form the vibrating film 150 including the air inlet 180. In this case, the insulating film 190 is also simultaneously etched. The air inlet 180 is formed in the second vibrating region 165 of the vibrating film 150. The air inlet 180 includes the first slot 181, the through-hole 183, and the bending part 185 as illustrated in FIG. 3, or includes the second slot 187 as illustrated in FIG. 4.

Figure 10:
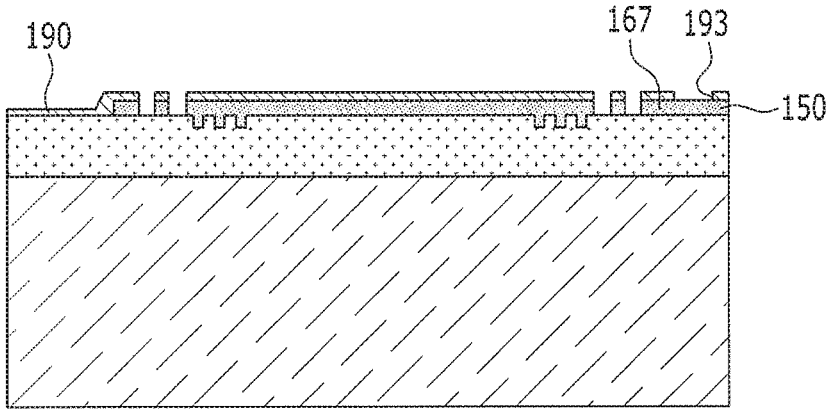

Referring to FIG. 10, the insulating film 190 is etched to form the first contact hole 193.

That is, a portion of the insulating film 190 is etched to expose the vibrating film 150 corresponding to the first contact hole 193. In this case, the first contact hole 193 may be formed at a position corresponding to the third vibrating region 167 of the vibrating film 150.

Figure 11:
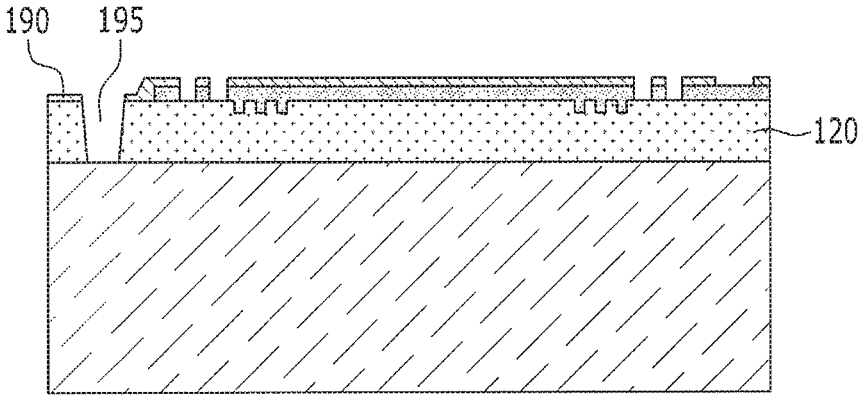

Referring to FIG. 11, the insulating film 190 and the sacrificial layer 120 are etched to form the second contact hole 195.

That is, a portion of the insulating film 190 and the sacrificial layer 120 is etched to expose the substrate 110 corresponding to the second contact hole 195.

Figure 12:
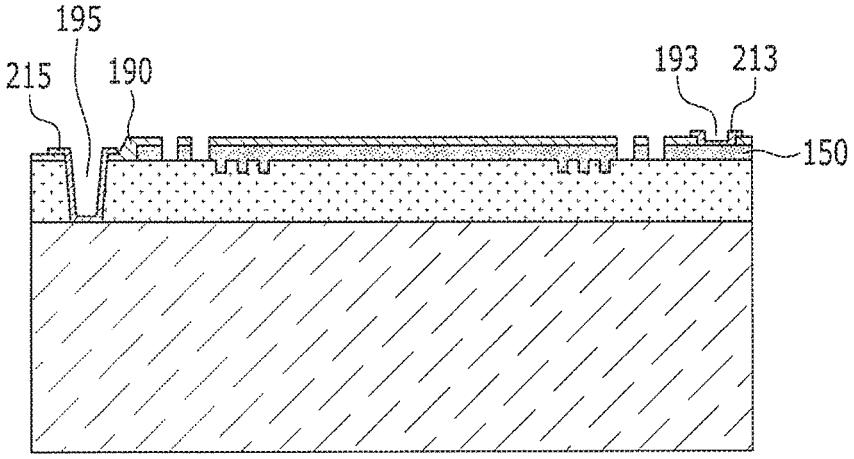

Referring to FIG. 12, the first pad 213 and the second pad 215 are formed on the insulating film 190.

That is, the first pad 213 connected to the vibrating film 150 is formed on the first contact hole 193 and the insulating film 190, and the second pad 215 connected to the substrate 110 is formed on the second contact hole 195 and the insulating film 190.

The first pad 213 and the second pad 215 may be formed of a metal so as to be electrically connected to the processing module.

Figure 13:
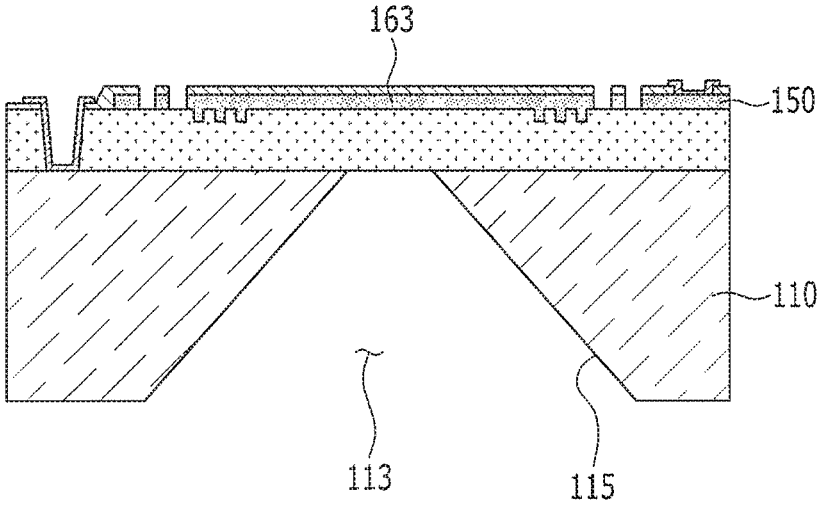

Referring to FIG. 13, the substrate 110 is etched to form the acoustic hole 113. The acoustic hole 113 may be formed in different shape according to an etching method.

That is, the substrate 110 is wet-etched to form the acoustic hole 113 including the inclined surface 115. The inclined surface 115 may have an inner diameter which decreases toward the vibrating film 150. The acoustic hole 113 may be formed at a position corresponding to the first vibrating region 163 of the vibrating film 150.

The substrate 110 is also dry-etched to form the acoustic hole 113 illustrated in FIG. 1. In this case, an inner circumference surface of the acoustic hole 113 may be perpendicular to an outer surface of the substrate 110.

Figure 14:
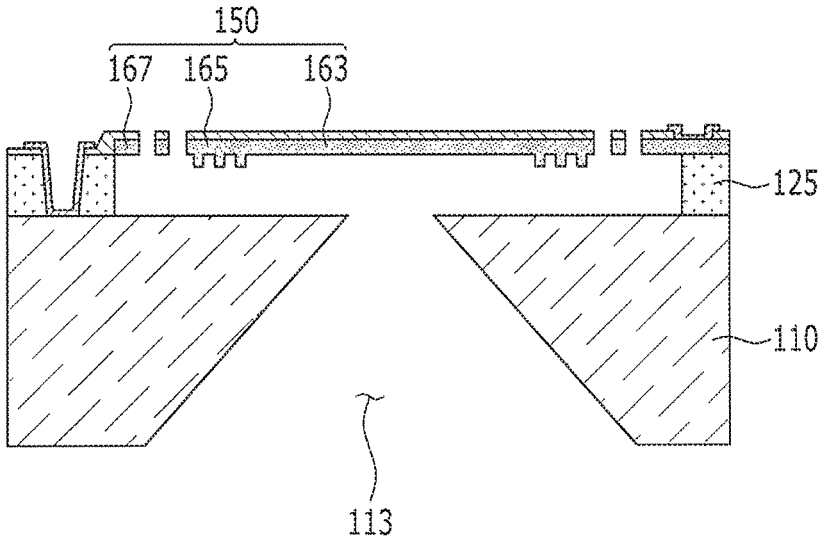

Referring to FIG. 14, the sacrificial layer 120 is removed to form the supporting layer 125.

That is, a portion of the sacrificial layer 120 formed on the substrate 110 is removed to form the supporting layer 125 along a circumference of the substrate 110. In this case, the sacrificial layer 120 may be removed so that portions of the first vibrating region 163, the second vibrating region 165, and the third vibrating region 167 of the vibrating film 150 are exposed.

As described above, since the microphone 100 according to the present disclosure may minimize the damping which may occur in the air layer formed between the vibrating film 150 and the fixed film by removing the fixed film, frequency response characteristics and noise characteristics may be improved, and the process step may be reduced, thereby making it possible to simplify the process.

As described above, since the microphone according to the present disclosure may minimize the damping which may occur in the air layer formed between the vibrating film and the fixed film by removing the fixed film, frequency response characteristics and noise characteristics may be improved, and the process step may be reduced, thereby making it possible to simplify the process.

Hereinabove, although the present disclosure has been described in detail with reference to the exemplary embodiment of the present disclosure, it is to be understood by those skilled in the art that the present disclosure may be variously modified and altered without departing from the scope and spirit of the present disclosure as disclosed in the accompanying claims.

What is claimed is:

1. A manufacturing method of a microphone, the manufacturing method comprising steps of:

preparing a substrate;

forming a sacrificial layer on the substrate;

forming a conductive layer on the sacrificial layer;

forming an insulating film on the conductive layer and forming the conductive layer as a vibrating film;

etching the insulating film to define a first contact hole;

etching the sacrificial layer and the insulating film to define a second contact hole;

forming a first pad to be disposed in the first contact hole and connected to the vibrating film;

forming a second pad to be disposed in the second contact hole and connected to the substrate etching the substrate to define an acoustic hole; and etching the sacrificial layer to form a supporting layer along a circumference of the substrate, wherein the vibrating film includes:

a first vibrating region disposed at a portion corresponding to the acoustic hole, a second vibrating region connected to the first vibrating region, and including an air inlet, and a third vibrating region connected to the second vibrating region through a plurality of connection parts.

2. The manufacturing method of claim 1, wherein the air inlet includes:

a first slot disposed between two connection parts; and a plurality of through-holes positioned between the first vibrating region and the first slot, wherein the first slot includes a bending part bent toward the first vibrating region at both end portions of the first slot.

3. The manufacturing method of claim 2, wherein the air inlet includes a second slot disposed between the two connection parts.

4. The manufacturing method of claim 3, wherein a width of the second slot is greater than a width of the first slot.

5. The manufacturing method of claim 1, wherein in the step of etching the substrate to define an acoustic hole, the substrate is wet-etched and has an inner circumference surface of the acoustic hole in an inclined surface.

6. The manufacturing method of claim 5, wherein the acoustic hole is defined in the inclined surface of the substrate, in which an inner diameter of the substrate decreases toward the vibrating film.

* * * * *